US006543162B1

(12) United States Patent
Niedfeld

(10) Patent No.: US 6,543,162 B1
(45) Date of Patent: Apr. 8, 2003

(54) MONEY POCKET

(75) Inventor: Vincent Niedfeld, 2729 Beltagh Ave., Bellmore, NY (US) 11710

(73) Assignee: Vincent Niedfeld, Bellmore, NY (US)

( * ) Notice: Subject to any disclaimer, the term of this patent is extended or adjusted under 35 U.S.C. 154(b) by 50 days.

(21) Appl. No.: 09/706,635

(22) Filed: Nov. 6, 2000

Related U.S. Application Data

(63) Continuation of application No. 09/340,086, filed on Jun. 25, 1999, now Pat. No. 6,148,550.

(51) Int. Cl.[7] ..... G09F 1/00

(52) U.S. Cl. ..... 40/124.06; 40/630; 40/638; 40/661.09

(58) Field of Search ..... 40/124.06, 630, 40/638, 661.09

(56) References Cited

U.S. PATENT DOCUMENTS

| | | | | | |
|---|---|---|---|---|---|
| 1,803,234 | A | * | 4/1931 | Clark | |
| 2,176,535 | A | * | 10/1939 | Markoff | 40/124.06 |
| 2,611,369 | A | * | 9/1952 | Herrick | 40/776 |
| 3,319,369 | A | * | 5/1967 | Severson | 40/654.01 |
| 3,436,854 | A | | 4/1969 | Wurzburg et al. | |
| 3,638,343 | A | | 2/1972 | West | |
| 3,921,319 | A | | 11/1975 | Styers et al. | |
| 3,970,332 | A | * | 7/1976 | Alford, Jr. | 40/124.06 X |
| 4,184,276 | A | * | 1/1980 | Hernandez | 40/644 |
| 4,305,216 | A | * | 12/1981 | Skelton | 40/776 X |
| 4,389,801 | A | | 6/1983 | Sharrock et al. | |
| 4,434,889 | A | | 3/1984 | Fery | |
| 4,440,298 | A | * | 4/1984 | Knight | 40/124.06 X |
| 4,890,402 | A | * | 1/1990 | Carroll | 40/124.06 |
| 4,927,179 | A | * | 5/1990 | Ehret et al. | 283/79 |
| 4,951,969 | A | * | 8/1990 | Epstein et al. | 40/638 X |
| 4,955,153 | A | * | 9/1990 | Albrecht et al. | 40/661 |
| 5,143,279 | A | * | 9/1992 | Gaines | 283/58 X |
| 5,569,503 | A | | 10/1996 | Piotroski | |
| 5,621,990 | A | * | 4/1997 | Blanchard | 40/124.06 |
| 5,670,219 | A | * | 9/1997 | Na | 428/8 |
| 5,829,790 | A | * | 11/1998 | Phillips | 40/638 X |
| 5,954,369 | A | * | 9/1999 | Seabrook | 283/117 |
| 6,003,254 | A | * | 12/1999 | Lorber | 40/124.06 |
| 6,256,913 | B1 | | 7/2001 | Pellegri | 40/654.01 |

* cited by examiner

*Primary Examiner*—Lynne H. Browne
*Assistant Examiner*—James M. Hewitt
(74) *Attorney, Agent, or Firm*—Dilworth & Barrese, LLP

(57) ABSTRACT

A money pocket adapted to be selectively fastened to the internal surface of a greeting card is provided. In a first embodiment, the money pocket includes a sheet of material having front and rear surfaces, a top edge, a bottom edge, and a pair of side edges. A continuous or discontinuous adhesive bead or strip is located adjacent the bottom and side edges. The adhesive strip is covered by a cover strip to prevent the adhesive from inadvertently becoming stuck to another object. In use, the cover strips are removed from the adhesive strip(s) and the back surface of the money pocket is secured to the inner surface of a greeting card. Since there is no adhesive adjacent the top edge of the money pocket, the top edge defines an opening to a pocket into which money or checks can be securely positioned. Alternately, the money pocket may include first and second sheets of material which together define a pocket. Adhesive is positioned on the back sheet to facilitate attachment of the money pocket to the internal surface of a greeting card.

18 Claims, 5 Drawing Sheets

MONEY POCKET

This application is a Continuation of application Ser. No. 09/340,086, now U.S. Pat. No. 6,148,550, which was filed Jun. 25, 1999, and is hereby incorporated herein by reference.

BACKGROUND

1. Technical Field

The present disclosure relates generally to a pocket adapted to be secured to the inner surface of a greeting card and, more specifically, to a pocket, including an adhesive backing, configured and dimensioned to receive paper currency and/or checks.

2. Background of Related Art

Greeting cards in the form of a pocket, i.e., money holders, into which paper currency or checks can be inserted, are well known. Typically, money holders are rectangular in shape and include a front flap, a rear flap and an inner flap positioned between the front and rear flaps. The inner flap is secured to the rear flap along three of its sides to define a pocket which is dimensioned to receive paper currency.

Although money holders may include a decorative outer flap which may or may not include some form of salutation, e.g., happy birthday, Merry Christmas, etc., the selection of money holders in greeting card stores is very limited. Thus, where a person desires to give a monetary gift to another in a money holder, it is not unusual if the person is unable to locate a money holder that accurately expresses his or her feelings or wishes, or includes the appropriate comical relief. Thus, the person must purchase a greeting card without a pocket that more accurately expresses his or her feelings or the person must purchase the money pocket despite its misgivings.

One problem associated with placing paper currency in a greeting card not having a pocket is that the likelihood that the paper currency will fall from the card and be lost is greatly increased. This problem is worsened where at large events, such as weddings, a large number of cards are handled.

Accordingly, a need exists for a pocket which can be easily and quickly secured to the internal surface of a greeting card to convert any greeting card into a money holder.

SUMMARY

In accordance with the present disclosure, a money pocket adapted to be selectively fastened to the internal surface of a greeting card is provided. In a first embodiment, the money pocket includes a sheet of material having front and rear surfaces, a top edge, a bottom edge, and a pair of side edges. An adhesive bead or strip is located adjacent the bottom and side edges. The adhesive strip is covered by a cover strip to prevent the adhesive from inadvertently becoming stuck to another object. Preferably, the sheet is non-opaque and the front surface includes a salutation and/or an ornamental design.

In use, the cover strips are removed from the adhesive strip(s) and the back surface of the money pocket is secured to the inner surface of a greeting card. Since there is no adhesive adjacent the top edge of the money pocket, the top edge defines an opening to a pocket into which money or checks can be securely positioned.

In another embodiment, the money pocket includes first and second sheets of material which together define a pocket. Adhesive is positioned on the back sheet to facilitate attachment of the money pocket to the internal surface of a greeting card.

BRIEF DESCRIPTION OF THE DRAWINGS

Various preferred embodiments of the money pocket for attachment to a greeting card are described herein with reference to the drawings, wherein.

DETAILED DESCRIPTION OF PREFERRED EMBODIMENTS

Figure 1:
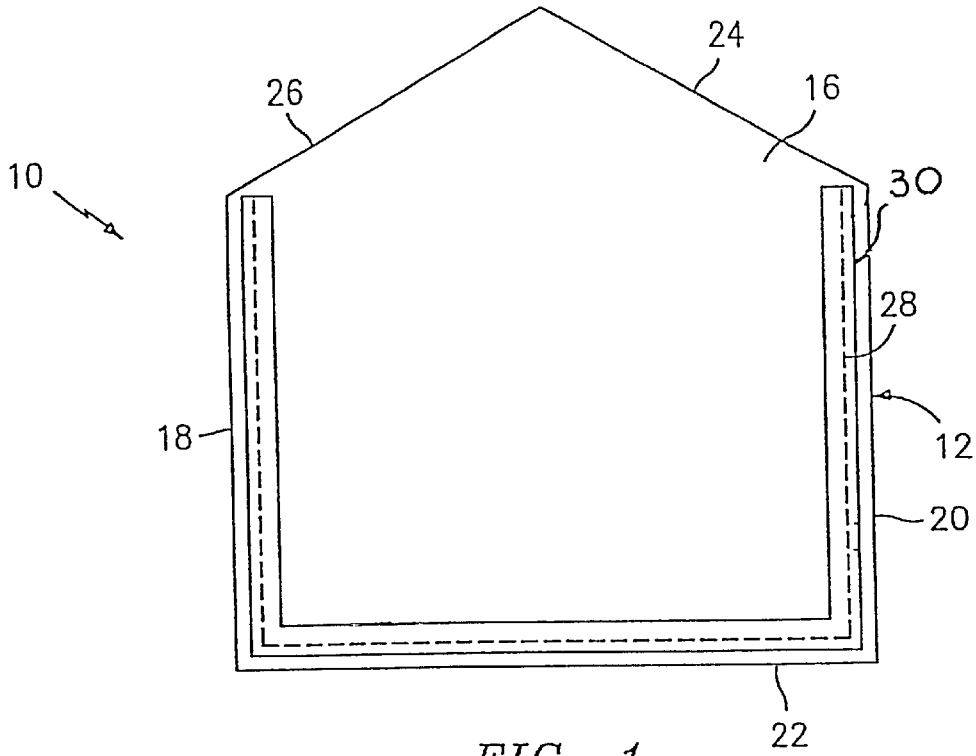
FIG. 1 is a rear view of one embodiment of the presently disclosed money pocket for attachment to a greeting card.

Preferred embodiments of the presently disclosed money pocket for attachment to a greeting card or the like will now be described in detail with reference to the drawings, in which like reference numerals designate identical or corresponding elements in each of the several views.

Figure 2:
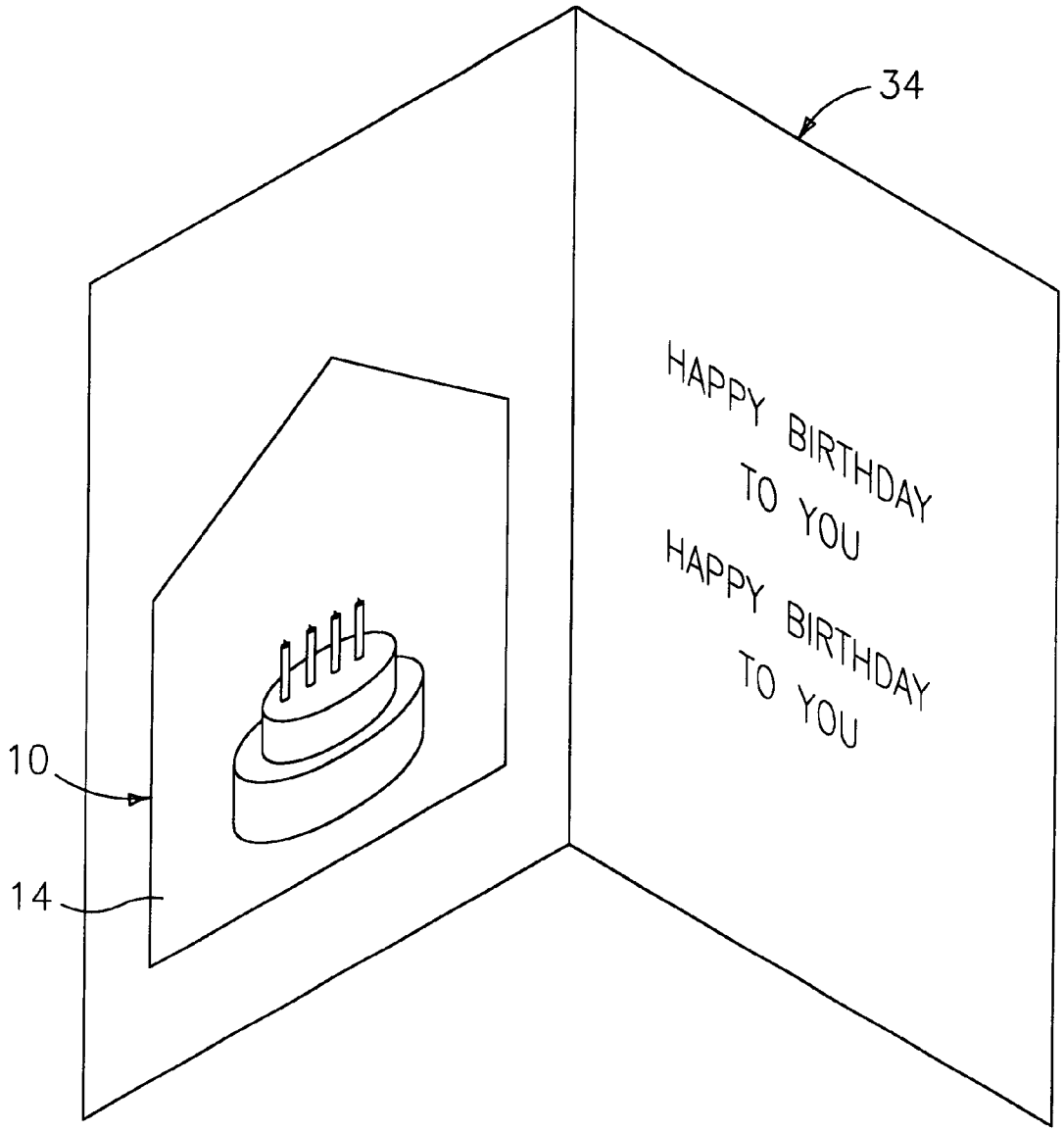
FIG. 2 is a perspective view of the money pocket shown in FIG. 1 secured to a greeting card.
Figure 7:
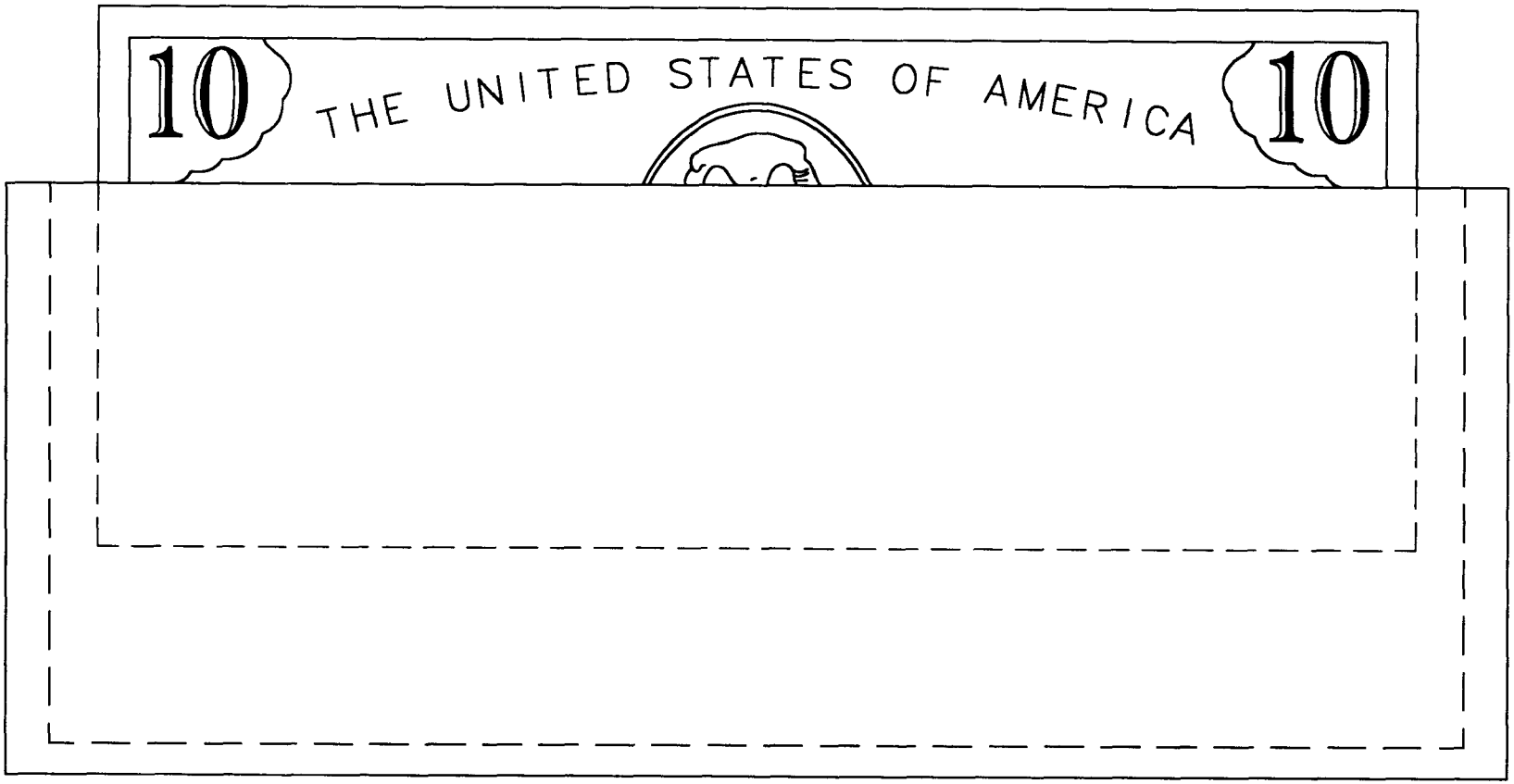
FIG. 7 is a front view of another embodiment of the presently disclosed money pocket for attachment to a greeting card.

FIGS. 1 and 2 illustrate one embodiment of the presently disclosed money pocket shown generally as 10. Money pocket 10 includes a first sheet of material 12 having a front surface 14 (FIG. 2) and a rear surface 16. Sheet of material 12 is preferably constructed from a paper product, although other materials, such as plastics, etc., may also be used to form the sheet. Preferably, the sheet is dimensioned to receive unfolded paper currency. For example, in the United States, the sheet of material can be approximately 2.5 inches×6 inches. These dimensions may vary in different countries. See FIG. 7. Alternately, sheets having other dimensions are envisioned. Pocket 10 includes a pair of side edges 18 and 20, a bottom edge 22 and top edges 24 and 26. A discontinuous bead or strip of pressure sensitive adhesive 28 extends along side edges 18 and 20 and bottom edge 22 of rear surface 16. Alternately, a continuous strip of adhesive may be applied to the rear surface of the pocket adjacent the side and bottom edges. A cover strip 30 is positioned over the adhesive strip 28. Cover strip 30 prevents the adhesive from sticking to another surface prior to being secured to a greeting card.

Referring to FIG. 2, front surface 14 of money pocket 10 preferably includes an ornamental design and/or a salutation. For example, the pocket may include a picture of a birthday cake with the salutation "Happy B-Day". Alternately, other greetings or salutations in combination with other designs may also be provided on front surface 14 of money pocket 10.

In order to attach money pocket 10 to greeting card 34, cover strip 30 is removed and rear surface 16 of pocket 10 is pressed against one flap, e.g., front flap 36, of card 34 to press the adhesive strip 28 against the flap. After the money pocket 10 has been secured to the flap, the flap and money pocket 10 form a pocket having an opening defined by edges 24 and 26 of pocket 10 and flap 36 of card 34. Paper currency can be placed within the pocket formed between money pocket 10 and flap 36 of card 34.

Figure 3:
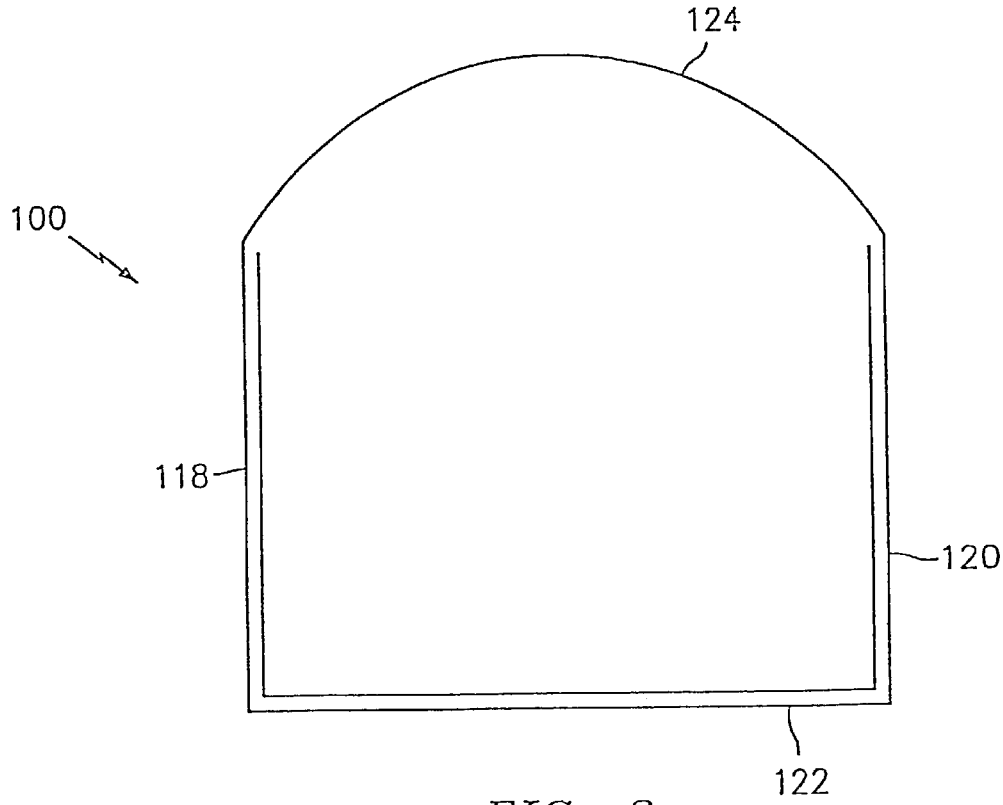
FIG. 3 is a rear view of another embodiment of the presently disclosed money pocket for attachment to a greeting card.
Figure 4:
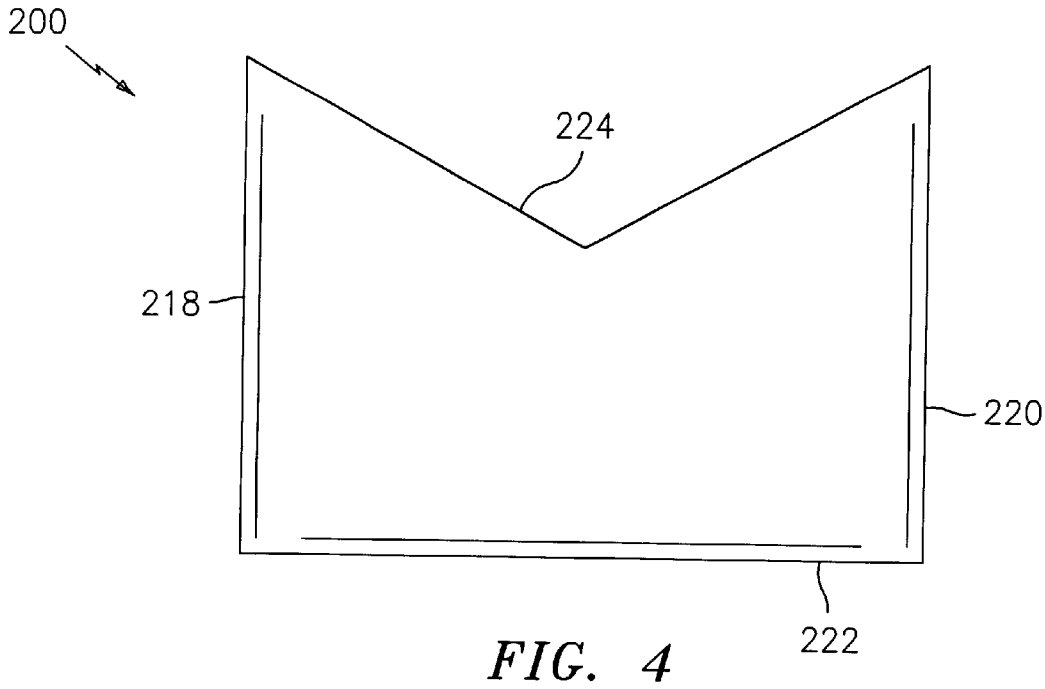
FIG. 4 is a rear view of another embodiment of the presently disclosed money pocket for attachment to a greeting card.
Figure 5:
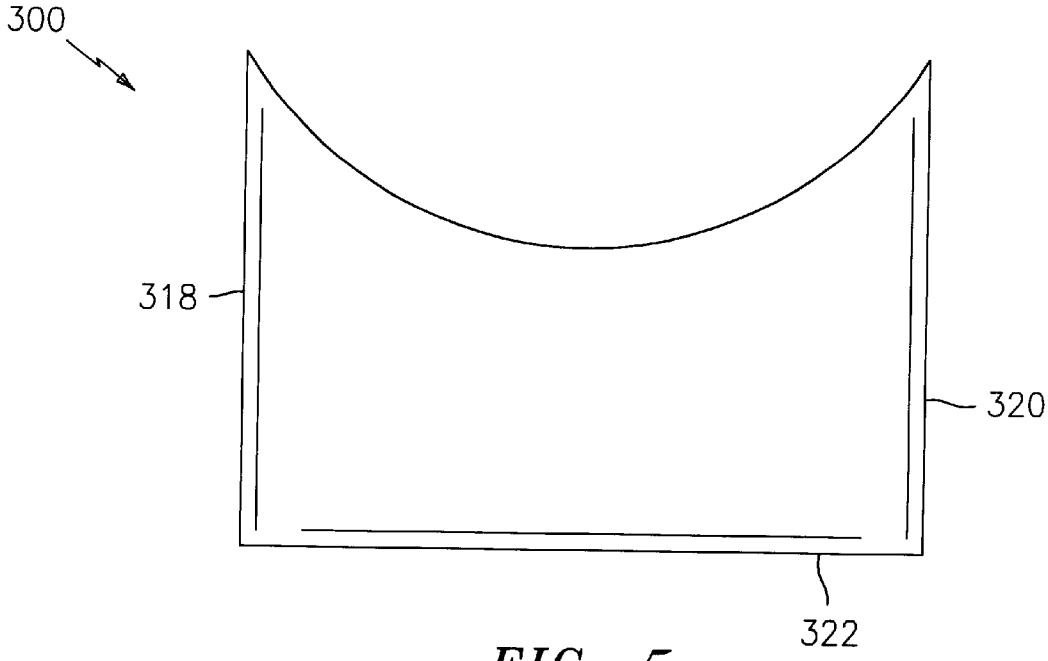
FIG. 5 is a rear view of yet another embodiment of the presently disclosed money pocket for attachment to a greeting card.

Referring to FIGS. 3–5, the money pocket may have a variety of different configurations. For example, money pocket 100 shown in FIG. 3 includes a convex, semi-circular top edge 124, parallel side edges 118 and 120 and a bottom edge 122. A continuous strip of adhesive 128 is positioned adjacent edges 118, 120 and 122. Money pocket 200, shown in FIG. 4 includes a V-shaped top edge 224, parallel side edges 218 and 220 and a bottom edge 222. A bead of adhesive is positioned adjacent edges 218, 220 and 222. Finally, money pocket 300, shown in FIG. 5 includes a concave, semi-circular top edge 324, parallel side edges 318 and 320 and a bottom edge 322. A bead of adhesive is positioned adjacent edges 318, 320 and 322. As discussed above with respect to money pocket 10, each of the money pockets 100, 200 and 300 may include a salutation and/or an ornamental design on its front surface. Moreover, a cover strip (not shown) is positioned over the adhesive to prevent the pocket from inadvertently sticking to another surface before it is placed within a greeting card.

Figure 6:
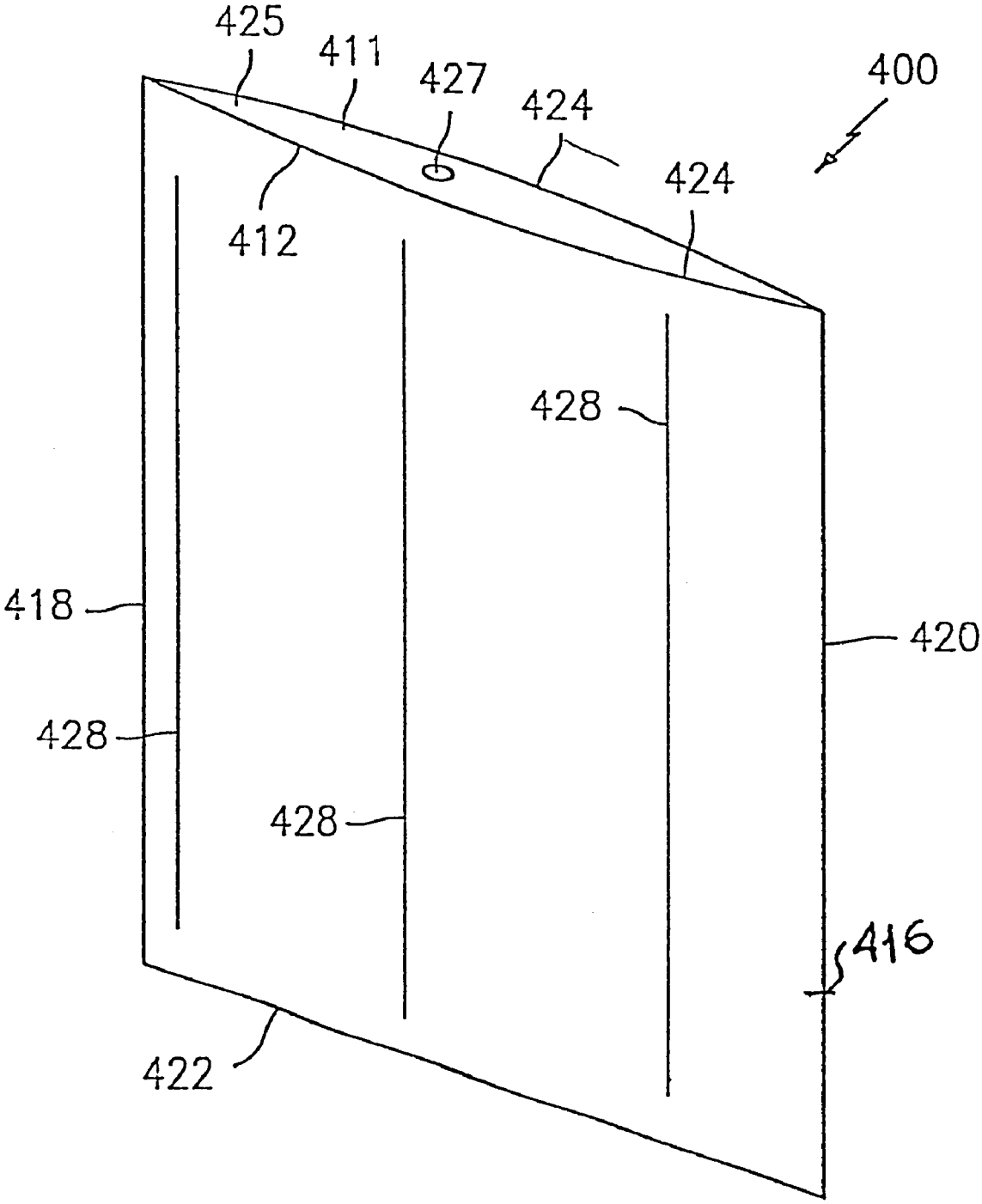
FIG. 6 is a perspective view of another embodiment of the presently disclosed money pocket for attachment to a greeting card.

FIG. 6 illustrates another embodiment of the money pocket shown generally as 400. Money pocket 400 includes first and second sheets of material 411 and 412. Sheets 411 and 412 each include a top edge 424, a pair of side edges 418 and 420 and a bottom edge 422. The bottom and side edges are sealed together to define a pocket 425. Sheet 412 forms the rear surface 416 of money pocket 410. Spaced adhesive strips 428 are positioned on rear surface 416 to facilitate attachment to the internal surface of a greeting card. As discussed above, cover strips may be provided to cover the adhesive until attachment to a greeting card is desired. One of sheets 411 and 412 may also include a small adhesive bead 427 adjacent top edge 424 lightly seal the pocket 425 after a gift has been positioned therein.

It will be understood that various modifications may be made to the embodiments disclosed herein. For example, the particular configuration of the pocket need not be as disclosed but rather may be selectively varied to suit a particular type of greeting card. For example, the money pocket can be formed in the shape of a pumpkin or a Christmas tree. As such, adhesive is provided over a portion of the outer boundary of the pocket. The amount of adhesive applied to the pocket should be sufficient to retain paper currency within the pocket after it has been secured within a greeting card. Therefore, the above description should not be construed as limiting, but merely as exemplifications of preferred embodiments. Those skilled in the art will envision other modifications within the scope and spirit of the claims appended hereto.

What is claimed is:

1. A greeting card comprising:

at least one sheet of material having a front surface and a rear surface and an outer boundary;

an adhesive strip being positioned on the rear surface of the at least one sheet of material adjacent the outer boundary;

at least one gap in the adhesive strip;

the rear surface of the at least one sheet of material being attached to an internal surface of the greeting card, thereby forming a money pocket; the at least one gap being dimensioned to allow passage of paper currency; and indicia provided across a central region of and atop the front surface of the at least one sheet of material.

2. A money pocket according to claim 1, wherein the adhesive strip is a single strip extending over a substantial portion of the outer boundary along the rear surface of the at least one sheet of material so that opposite ends of the single strip define the at least one gap therebetween.

3. A money pocket according to claim 1, wherein the adhesive strip includes a plurality of spaced portions.

4. A money pocket according to claim 1, wherein the indicia include a salutation provided on and across the central region of the front surface of the at least one sheet of material.

5. A money pocket according to claim 1, wherein the indicia include an ornamental design provided on and across the central region of the front surface of the at least one sheet of material.

6. A money pocket according to claim 1, wherein the indicia include a salutation and an ornamental design provided on and across the central region of the front surface of the at least one sheet of material.

7. A money pocket according to claim 1, wherein the at least one sheet of material is dimensioned to receive paper currency.

8. A money pocket according to claim 1, wherein the sheet of material has dimensions slightly larger than United States paper currency.

9. A greeting card comprising first and second sheets of material attached to one another along a portion of outer peripheries thereof to form a pocket, each of the first and second sheets having a respective front surface and a respective rear surface, the rear surface of the second sheet of material including means for attaching the pocket to an internal surface of the greeting card;

wherein the means for attaching is positioned on the rear side and about at least a portion of the outer periphery of the second sheet of material to secure the pocket to an internal surface of the greeting card, whereas the pocket is dimensioned to receive paper currency, the front surface of the first sheet of material being provided with indica across a central region thereof.

10. A money pocket according to claim 9, wherein the indicia comprises a salutation.

11. A money pocket according to claim 9, wherein the indicia comprises an ornamental design.

12. A money pocket according to claim 9, further comprising a salutation and an ornamental design provided on the front surface of the first sheet of material.

13. A money pocket according to claim 9, wherein the means for attaching includes an adhesive.

14. A money pocket according to claim 13, wherein the adhesive is in the form of an adhesive strip formed at least partially about the periphery of the bottom surface of the second sheet of material.

15. A method for converting a greeting card to a greeting card/money pocket, the method comprising the following steps:

a) providing a money pocket having one sheet of material and another sheet of material attached to one another along a portion of outer peripheries thereof so as to define a pocket;

b) securing a rear surface of the one sheet of material to a surface of a greeting card; and c) providing indicia on a central region of the front surface of the other sheet of material facing away from the surface of the greeting card.

16. A method according to claim 15, wherein the indicia include a salutation on the front surface of the money pocket.

17. A method according to claim 15, wherein the indicia include an ornamental design on the front surface of the money pocket.

18. A greeting card comprising:

a single-layer sheet of material having opposite front and rear surfaces defining an outer boundary;

an adhesive strip being provided on the rear surface of the single-layer sheet of material along the outer boundary and having a gap; and the rear surface of the sheet of material being attached to an internal surface of the greeting card, thereby forming a money pocket, said gap dimensioned to allow passage of paper currency; the front surface of the single-layer sheet of material having a central region spaced from the outer boundary, the central region provided with a salutation or an ornamental design.

* * * * *